United States Patent [19]

Childs

[11] 4,410,335

[45] Oct. 18, 1983

[54] MULTIFUNCTIONAL GASOLINE ADDITIVES

[75] Inventor: Michael E. Childs, Wilmette, Ill.

[73] Assignee: UOP Inc., Des Plaines, Ill.

[21] Appl. No.: 349,431

[22] Filed: Feb. 16, 1982

Related U.S. Application Data

[63] Continuation-in-part of Ser. No. 306,263, Sep. 28, 1981, abandoned, which is a continuation of Ser. No. 161,829, Jun. 23, 1980, abandoned.

[51] Int. Cl.[3] ..... C10L 1/22

[52] U.S. Cl. ..... 44/72; 44/DIG. 1

[58] Field of Search ..... 44/72, DIG. 1; 252/394, 252/396

[56] References Cited

U.S. PATENT DOCUMENTS

| | | | |
|---|---|---|---|
| 2,695,222 | 11/1954 | Chenicek et al. | 44/72 |
| 2,902,354 | 9/1959 | Giammaria | 44/72 |
| 3,092,475 | 6/1963 | Cole et al. | 44/72 |
| 4,134,846 | 1/1979 | Machleder | 252/55.5 |

*Primary Examiner*—Charles F. Warren
*Assistant Examiner*—Y. Harris-Smith
*Attorney, Agent, or Firm*—James R. Hoatson, Jr.; Eugene I. Snyder; Page, II: William H.

[57] ABSTRACT

The reaction products of epoxides, containing from about 6 to about 20 carbon atoms, with unsubstituted alkylenediamines, N-alkyl alkylenediamines, N-alkoxyalkyl alkylenediamines and poly (ethyleneamines) are effective carburetor detergents and reduce deposits on various components of internal combustion engines. Internal epoxides containing at least one branched alkyl group afford reaction products with particularly desirable properties.

22 Claims, No Drawings

MULTIFUNCTIONAL GASOLINE ADDITIVES

CROSS-REFERENCE TO RELATED APPLICATIONS

This application is a continuation-in-part of my copending application, Ser. No. 306,263, filed Sept. 28, 1981, now abandoned, which is a continuation of Ser. No. 161,829, filed June 23, 1980, now abandoned, all of which are incorporated by reference.

BACKGROUND OF THE INVENTION

In the normal course of use, deposits form on many parts of an internal combustion engine and components. Deposits which form on various parts of a carburetor are particularly vexing, leading to a decrease in overall efficiency of combustion attended by increasing gas consumption and undesirable exhaust gas emissions. Deposits also tend to accumulate on other parts of the fuel induction system, such as valves and ports, with similar adverse effects.

An object of this invention is to provide additives which when added to fuel oils, especially gasoline, in minor amounts act as an effective carburetor detergent. Another object of this invention is to provide additives which when added to fuel oils, especially gasolines, in minor amounts materially reduce deposits accumulating on valves and ports of internal combustion engines. Such materials may have additional desirable properties when added to gasoline and used in internal combustion engines. For example, materials of this invention may inhibit gum formation, may act as anti-stalling or carburetor de-icing agents, as corrosion inhibitors, and so forth. Still another object is to provide additives effective as carburetor detergents at concentrations less than about 100 parts per million. Materials in the prior art generally are required to be used at a concentration over about 100 parts per million, as exemplified in U.S. Pat. No. 4,134,846.

Materials bearing a superficial resemblance to those of the present invention have found varying uses in the prior art. Vicinal alkanol amines containing 20 or fewer carbon atoms have been used as sedimentation inhibitors in blended burner oils, U.S. Pat. No. 2,695,222. The materials described there are monoamines, preferably primary amines, whereas the additives described herein invariably are non-primary polyamine alkanols. The reaction product of N-alkyl ethylenediamine or propylenediamine with varying weight ratios of alkylene oxides containing 4 or fewer carbon atoms has been claimed to be effective in stabilizing fuel oils against oxidative deterioration, U.S. Pat. No. 3,092,475. However, the materials described herein result from higher alkylene oxides, including internal epoxides, and especially epoxides containing branched chains.

The condensation product of diamines with ethylene or propylene oxide described in U.S. Pat. No. 2,902,354 results from one mole proportion oxide per amino hydrogen. In contrast, the condensation products described herein result from one mole proportion oxide per primary amino group. This difference results in several important distinguishing characteristics for the products of this invention. One distinction is that in forming the products herein applicant never uses more than about half the mole proportion of oxide required by the patentee. Another distinction is that where the polyamine bears a secondary amino group, the condensation products of this invention have the same, unchanged secondary amino groups. A third important distinction is that in the products of this invention a primary amino group is transformed into a secondary amino group—i.e., the amino nitrogen bears one hydrogen atom—whereas the patentee's products are characterized by transformation of all amino groups into tertiary amino groups—i.e., the amino nitrogen bears no hydrogen atoms. A corollary of this distinction is that in the case of polyamines bearing two primary amino groups the materials herein are dihydric alcohols, whereas the patentee's materials are tetrahydric alcohols; in all other cases the materials herein are monohydric alcohols, whereas the patentee's materials are *at least* trihydric alcohols.

SUMMARY OF THE INVENTION

An object of this invention is to provide materials with desirable carburetor detergency properties at concentrations greater than about 10 ppm but less than about 100 parts per million when added to fuel oils, especially gasoline. An embodiment of this invention is the reaction product of epoxides with diamines. In a more specific embodiment the epoxide contains from about 6 to about 20 carbon atoms. In another embodiment the amine is ethylene diamine. In yet another embodiment the amine is an N-alkyl or N-alkoxyalkyl propylene diamine.

DESCRIPTION OF THE INVENTION

The materials of this invention are the reaction products of epoxides with polyamines. By epoxides are meant compounds of the structure

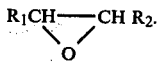

The groups $R_1$, $R_2$ of the epoxide are a hydrogen or hydrocarbyl group containing up to about 18 carbon atoms. The hydrocarbyl group may be straight-chain or branched, and may be saturated or unsaturated, although saturated hydrocarbyl groups are preferred. Examples of hydrocarbyl groups suitable for use in this invention include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl. An essential limitation is that the sum of the carbon atoms in $R_1$ and $R_2$ is at least 4 but not more than about 18. Where the epoxide is internal, i.e. neither $R_1$ nor $R_2$ is hydrogen, the reaction products of this invention are particularly desirable.

Another preferred class of reaction products results when at least one of $R_1$, $R_2$ and most preferably both, are branched chain hydrocarbyl groups, for such reaction products have especially desirable solubility properties in fuel oils, particularly gasoline. Examples of such branched chain groups, cited only for purposes of illustration and not by way of limitation, include isopropyl, 1-methylpropyl, 2-methylpropyl, 1-butyl, 1-methylbutyl, 2-methylbutyl, 3-methylbutyl, 1,1-dimethylpropyl, 2,2-dimethylpropyl, and so forth.

The term polyamine denotes an amine having at least two amino groups, at least one of which is an unsubstituted or primary amino group, $NH_2$. The products of this invention result largely from the reaction of an unsubstituted amino group with the epoxide to form a beta-amino alcohol whose general structure may be denoted as $R_1CHOHCHR_2NHA$, where A is the organic residue of the amine utilized. However, it is to be understood that where the polyamines of this invention contain a monosubstituted, or secondary, amino group, some fraction of the products of this invention may also result from reaction of the latter amino group with the methylene group of the epoxide.

The reaction products described here result from reaction of about 1 mole proportion of epoxide with one equivalent of a polyamine. By one equivalent of a polyamine is meant that amount of polyamine which furnishes one mole proportion of primary amino groups. Thus, if the polyamine has but one primary amino group per molecule, one equivalent is one mole proportion; if the polyamine has two primary amino groups per molecule, one equivalent is one-half mole proportion; if there be three primary amino groups per molecule, one equivalent is one-third mole proportion, and so forth. Although the reaction product is that from reaction of 1 mole proportion epoxide with one equivalent of a polyamine, a small excess of epoxide, up to about 30%, often is desirable to ensure complete reaction.

Amines which are suitable for use in this invention include unsubstituted and N-monosubstituted alkylenediamines and ethylene polyamines. The alkylene group of the alkylenediamines may contain from about 2 to about 8 carbon atoms, although alkylene groups containing 2 or 3 carbon atoms are preferred. Linear alkylene groups are more commonly employed than are branched alkylene groups, but the latter may be used, although not necessarily with equivalent results. Examples of linear alkylene groups include ethylene, propylene, butylene, amylene, hexylene, heptylene, and octylene. Examples of branched alkylene groups include isopropylene, sec-butylene, isobutylene, sec-amylene, iso-amylene, etc. It is to be noted that when unsubstituted alkylenediamines are employed the products are largely of the type $R_1CH(OH)CHR_2NH$-alk-$NHCHR_2CH(OH)R_1$, where alk designates the alkylene group.

The N-alkyl alkylenediamines of this invention are represented by the formula $R_3NH$-alk-$NH_2$, where alk designates the alkylene groups described above. In this branch of the invention a propylene group is a preferred alkylene group. In one aspect of this branch, $R_3$ is a hydrocarbyl or alkyl group containing from about 6 to about 22 carbon atoms which may be either saturated or unsaturated. Such hydrocarbyl groups often are obtained from and are characteristic of natural fats and oils, such as soybean oil, cottonseed oil, lard, tallow, coconut oil, and palm, sunflower and safflower oils, as examples. Specific examples of suitable hydrocarbyl groups include hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, oleyl, linolenyl. Since such groups commonly have their commercial origin in fatty acids, often they are supplied as mixtures. Therefore it is to be understood that amines containing a combination of the aforementioned groups are explicitly within the scope of this invention.

In another aspect of this branch of the invention, $R_3$ may be an alkoxyalkyl moiety. The "alkyl" portion of the alkoxyalkyl moiety is an alkylene group conforming to the description given above, although the embodiment where the alkylene group is a propylene group is preferred. The alkoxy group contains from about 1 to about 25 carbon atoms, but preferably from about 6 to about 20 carbon atoms. suitable groups representative of the carbonaceous portion of the alkoxy group include methyl, ethyl, propyl, butyl, pentyl, hexyl, heptyl, octyl, nonyl, decyl, eicosyl, pentacosyl, etc. Such groups commonly have their commercial origin in fatty acids and petroleum-derived alcohols, and consequently are often supplied as mixtures. Therefore it is to be understood that amines containing a combination of the aforementioned group are explicitly within the scope of this invention.

When the carbonaceous portion of the alkoxy group is obtained from fatty acids the major portion is an unbranched aliphatic group. When the carbonaceous portion comes from petroleum-derived alcohols the major portion generally is a branched aliphatic group. In each case minor amounts of unsaturated material may be present. Therefore it is to be understood explicitly that the carbonaceous portion of the alkoxy group of the alkoxyalkylamines of this invention may be comprised of either a major portion of unbranched or branched aliphatic groups which may contain minor amounts of unsaturation.

Other polyamines which may be used in this invention have the formula $H_2N(CH_2CH_2NH)_xH$, where x is an integer from about 2 to about 8. Examples of such polyamines include diethylenetriamine, triethylenetetraamine, tetraethylenepentamine, pentaethylenehexamine, etc. Polyamines where x is 2 or 3 are preferred materials, that is, diethylenetriamine and triethylenetetraamine are preferred in this branch of the invention.

The materials described herein may be advantageously employed as a detergent in a broad variety of fuel oil, for example, diesel oil, aviation oil, gasoline, burner oil, etc., although their use in gasoline is particularly advantageous. Such materials when used as additives exhibit detergent properties at concentrations at least as low as 25 parts per million, although some may be useful at concentrations as low as about 10 parts per million. It has been found that gasoline containing greater than about 10 but less than about 100 parts per million of additives of this invention has advantages in preventing deposits on working parts of carburetors and on the valves and ports of internal combustion engines with economic considerations dictating usage at their lowest effective level. In a preferred embodiment the additives are used at a concentration from about 25 to about 75 ppm. Such compositions also may contain other additives, for example antioxidants, so as to provide a gasoline with a complete spectrum of functional additives.

The additives of this invention may be conveniently prepared by heating the epoxide with an equivalent, as defined above, of amine. Reaction temperatures from about 100° C. to about 200° C. and higher may be used, although the lower range of temperatures is advantageous in minimizing charring, color body development, etc. Frequently, it is advantageous to use a solvent to moderate the reaction and to promote ease of handling. The nature of such solvents is not critical, so long as they are unreactive to both reactants and products. Aromatic solvents, especially those whose boiling point is in the aforementioned range, are a commonly used class of solvents, and include materials such as toluene, ethylbenzene, the xylenes, and so forth. When such solvents are used the reaction often is conducted at the temperature of reflux. Generally the reaction is complete in 3 to 10 hours.

Solvents commonly are employed in an amount so as to afford solutions containing about 50% by weight of reaction product, used per se as additives. However, the solvent may be removed by suitable means, as by distillation, if desired and the high-boiling material may be used in toto as the additives of this invention. Further purification of the high-boiling material also may be effected, although generally this provides no substantial advantage.

The examples given below serve only to illustrate this invention, and are not intended to limit this invention in any way.

EXAMPLE 1

A 3-neck round bottom flask equipped with a condenser, thermometer, and magnetic stirring bar was charged with 25 g (0.1 mol) of a mixture of $C_{15-18}$ alpha-olefin epoxides, 5 g (0.1 mol) diethylenetriamine, and 30 g mixed xylenes. The mixture was heated under nitrogen at reflux for 6 hours, and the cooled reaction mixture was used without removal of solvent to afford a solution containing 50% active ingredient. If desired, solvent may be removed, as by evaporation under reduced pressure.

EXAMPLE 2

A 3-neck flask equipped as described in Example 1 was charged with 25 g (0.1 mol) of a mixture of $C_{15-18}$ alpha-olefin epoxides, 35 g (0.1 mol) of an N-alkoxypropyl-1,3-propylenediamine, where the alkoxy group was a mixture of 12–15 carbon saturated, straight chain alkyl moieties, and 60 g mixed xylenes. The mixture was heated at reflux under nitrogen for 6 hours, and the cooled solution containing 50% active ingredient was used.

EXAMPLE 3

The experimental procedure used was that of the prior examples, the charge consisting of 21 g (0.1 mol) of a $C_{16}$ alpha-olefin epoxide, 7.4 g (0.1 mol) 1,3-propylenediamine, and 28 g mixed xylenes. After reaction, the solution containing 50 g active ingredient was used.

EXAMPLE 4

The effectiveness of additives as carburetor detergents and in reducing valve deposits was measured as follows. A benchmounted engine was run for 5 hours on 4-minute cycles, each cycle being 1 minute at 1500 rpm and 3 minutes at idle, or about 550 rpm. At the end of this time the top and bottom of the carburetor plate was visually examined and given a rating from 0 (dirty) to 100 (clean). The total deposit on the intake valve was weighed in mg and is reported at TOT in the Table. The deposit remaining on the valve after the rim is scraped off is labeled RIM. The entry 600 is the sum of the visual ratings, each being 0 (dirty) to 100 (clean), for the cylinder wall, piston head, cylinder head, combustion chamber pick-up, intake valve seat, and exhaust port. Finally, the entry No. 4 is the visual rating, on the same 0–100 scale, for the intake valve insert. Results for several additives at a concentration of 25 ppm active ingredient are tabulated below.

TABLE 1

| | EVALUATION OF ADDITIVES | | | | |
|---|---|---|---|---|---|
| Additive | C.D. | TOT | RIM | 600 | No. 4 |
| Example 1 | 60/40 | 69.3 | 49.7 | 270 | 60 |

TABLE 1-continued

| | EVALUATION OF ADDITIVES | | | | |
|---|---|---|---|---|---|
| Additive | C.D. | TOT | RIM | 600 | No. 4 |
| Example 2 | 95/95 | 54.2 | 44.5 | 230 | 70 |
| Blank | 0/0 | 51.8 | 28.5 | 260 | 55 |

What is claimed is:

1. A composition comprising a major amount of a fuel oil and a minor amount greater than about 10 parts per million but less than about 100 ppm of the reaction product of 1 mole proportion of an epoxide of the formula

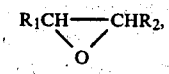

where $R_1$, $R_2$ are selected from the group consisting of hydrogen and hydrocarbyl containing up to about 18 carbon atoms, where the sum of carbon atoms in $R_1$, $R_2$ is at least 4 but not greater than about 18, with an equivalent of a polyamine selected from the group consisting of unsubstituted alkylenediamines, where the alkylene group contains from about 2 to about 8 carbon atoms, N-alkyl alkylenediamines, where the alkyl group contains from about 6 to about 22 carbon atoms, N-alkoxyalkyl alkylenediamines, where the alkoxy group contains from about 1 to about 25 carbon atoms and the alkyl portion is an alkylene group containing from about 2 to about 8 carbon atoms, and polyamines of the formula $H_2N(CH_2CH_2NH)_xH$, where x is an integer from about 2 to about 8.

2. The composition of claim 1 wherein the fuel oil is gasoline.

3. The composition of claim 1 wherein $R_1$ and $R_2$ each is a saturated hydrocarbyl group.

4. The composition of claim 3 wherein at least one of the groups $R_1$ or $R_2$ is a branched chain hydrocarbyl group.

5. The composition of claim 1 wherein the unsubstituted alkylenediamine is ethylenediamine or propylenediamine.

6. The composition of claim 1 wherein the N-alkyl alkylenediamine is an N-alkyl propylenediamine.

7. The composition of claim 6 wherein the N-alkyl group is a fatty acid alkyl group.

8. The composition of claim 7 wherein the N-alkyl group is N-oleyl or N-tallow.

9. The composition of claim 1 wherein the N-alkoxyalkyl alkylenediamine is N-alkoxypropyl propylenediamine.

10. The composition of claim 9 wherein the carbonaceous portion of the N-alkoxy group contains from about 6 to about 20 carbon atoms.

11. The composition of claim 1 wherein the polyamine is $H_2N(CH_2CH_2NH)_xH$ where x is an integer from about 2 to about 5.

12. A method of reducing carburetor deposits and deposits on other parts of the fuel induction system of an internal combustion engine comprising the addition to the fuel oil of an amount effective to reduce said deposits of the reaction product of 1 mole proportion of an epoxide of formula

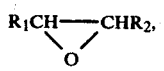

where $R_1$, $R_2$ are selected from the group consisting of hydrogen and hydrocarbyl containing up to about 18 carbon atoms, such that the sum of carbon atoms in $R_1$, $R_2$ is at least 4 but not greater than about 18, with an equivalent of a polyamine selected from the group consisting of unsubstituted alkylenediamines, where the alkylene group contains from about 2 to about 8 carbon atoms, N-alkyl alkylenediamines, where the alkyl group contains from about 6 to about 22 carbon atoms, N-alkoxyalkyl alkylene-diamines, where the alkoxy group contains from about 1 to about 25 carbon atoms and the alkyl portion is an alkylene group containing from about 2 to about 8 carbon atoms, and polyamines of the formula $H_2N(CH_2CH_2NH)_xH$, where x is an integer from about 2 to about 8.

13. The method of claim 12 wherein the fuel oil is gasoline.

14. The method of claim 12 wherein $R_1$ and $R_2$ each is a saturated hydrocarbyl group.

15. The method of claim 14 wherein at least one of the groups $R_1$, $R_2$ is a branched chain hydrocarbyl group.

16. The method of claim 12 wherein the unsubstituted alkylenediamine is selected from the group consisting of ethylenediamine and propylenediamine.

17. The method of claim 12 wherein the N-alkyl alkylenediamine is an N-alkyl propylenediamine.

18. The method of claim 17 wherein the N-alkyl group is a fatty acid alkyl group.

19. The method of claim 18 wherein the N-alkyl group is N-oleyl or N-tallow.

20. The method of claim 12 wherein the N-alkoxyalkyl alkylenediamine is N-alkoxypropyl propylenediamine.

21. The method of claim 20 wherein the carbonaceous portion of the N-alkoxy group contains from about 6 to about 20 carbon atoms.

22. The method of claim 12 wherein the polyamine is $H_xN(CH_2CH_2NH)_xH$, where x is an integer from about 2 to about 5.

* * * * *